US008191207B1

(12) United States Patent
Holscher

(10) Patent No.: US 8,191,207 B1
(45) Date of Patent: Jun. 5, 2012

(54) CORD PROTECTIVE APPARATUS AND ASSOCIATED METHOD

(76) Inventor: Christopher Holscher, Chesapeak, VA (US)

( * ) Notice: Subject to any disclaimer, the term of this patent is extended or adjusted under 35 U.S.C. 154(b) by 407 days.

(21) Appl. No.: 12/454,756

(22) Filed: May 22, 2009

Related U.S. Application Data

(60) Provisional application No. 61/128,513, filed on May 23, 2008.

(51) Int. Cl.
*B65D 63/00* (2006.01)
*B65D 63/18* (2006.01)
*B65D 63/10* (2006.01)

(52) U.S. Cl. ..... 24/16 R; 24/306

(58) Field of Classification Search ..... 24/115 R, 24/122.3, 136 R, 136 K, 115 H, 115 K, 16 R, 24/306; 439/371; 248/51, 60
See application file for complete search history.

(56) References Cited

U.S. PATENT DOCUMENTS

| | | | | | |
|---|---|---|---|---|---|
| 3,307,538 | A | * | 3/1967 | Groll | 602/4 |
| 3,947,927 | A | * | 4/1976 | Rosenthal | 24/306 |
| 3,994,048 | A | * | 11/1976 | Rosenthal | 24/306 |
| 4,182,005 | A | * | 1/1980 | Harrington | 24/16 PB |
| 4,431,226 | A | * | 2/1984 | Weilert | 294/150 |
| 4,639,980 | A | * | 2/1987 | Peterson | 24/306 |
| 4,712,766 | A | * | 12/1987 | Ehrenhalt | 251/90 |
| 4,856,149 | A | * | 8/1989 | Brame | 24/3.2 |
| 4,893,381 | A | * | 1/1990 | Frankel | 24/16 R |
| 4,939,818 | A | * | 7/1990 | Hahn | 24/16 R |
| 5,075,933 | A | * | 12/1991 | Kemper | 24/16 R |
| 5,075,934 | A | * | 12/1991 | Osedo | 24/16 R |
| 5,093,964 | A | * | 3/1992 | Rowland | 24/16 R |
| 5,136,759 | A | * | 8/1992 | Armour, II | 24/442 |
| 5,167,050 | A | | 12/1992 | Korsen | |
| 5,348,362 | A | | 9/1994 | Rolls | |
| 5,581,850 | A | * | 12/1996 | Acker | 24/16 PB |
| 5,604,961 | A | * | 2/1997 | Cole | 24/306 |
| 5,745,958 | A | * | 5/1998 | Kaldor | 24/16 R |
| 5,881,436 | A | * | 3/1999 | Lyons | 24/16 R |
| 6,049,953 | A | * | 4/2000 | McCay et al. | 24/302 |
| 6,138,882 | A | * | 10/2000 | Buettner | 224/250 |
| D439,564 | S | | 3/2001 | Huang | |
| 6,317,933 | B1 | * | 11/2001 | Suenaga | 24/16 R |
| 6,345,418 | B1 | * | 2/2002 | Bertrand et al. | 24/16 R |
| 6,523,229 | B2 | * | 2/2003 | Severson | 24/16 PB |
| 6,701,580 | B1 | * | 3/2004 | Bandyopadhyay | 24/16 R |
| 6,827,601 | B1 | | 12/2004 | Heaberle | |
| 7,404,238 | B2 | * | 7/2008 | McNeill | 24/16 PB |
| 7,469,854 | B2 | * | 12/2008 | Richardson | 242/402 |
| 7,588,216 | B1 | * | 9/2009 | Hoyl et al. | 248/74.3 |
| 7,849,568 | B2 | * | 12/2010 | Wilkinson | 24/298 |
| 2008/0201915 | A1 | * | 8/2008 | Obiols et al. | 24/306 |
| 2011/0030175 | A1 | * | 2/2011 | Tiedemann, Sr. | 24/306 |

* cited by examiner

*Primary Examiner* — Robert J Sandy
*Assistant Examiner* — Rowland D Do

(57) ABSTRACT

The cord protective apparatus includes a protective, flexible, slip-resistant sheath wrap for use with a cord or hose. Binding straps have opposite end portions each having corresponding hook and loop fastener portions, thereby allowing the sheath to wrap securely around the circumference of a hose for protecting said hose from incidental and accidental nicks and other damage that may occur when said hose is placed through a doorway or other high traffic areas. The apparatus further includes a hook to fasten the wrapped hose to a secure mounting structure and conveniently and tidily store said cord/hose in an appropriate place.

16 Claims, 4 Drawing Sheets

CORD PROTECTIVE APPARATUS AND ASSOCIATED METHOD

CROSS REFERENCE TO RELATED APPLICATIONS

This application claims the benefit of U.S. Provisional Application No. 61/128,513, filed May 23, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to power cords and, more particularly, to a cord protective apparatus for preventing wear and damage to power cords and pneumatic hoses.

2. Prior Art

Modern living requires a great number of electrical appliances, television sets and other components which are connected in some fashion to a power cord, a cable or some such conduit. Ordinarily, these items are strung inside walls and made available through so-called "convenience outlets". In older structures especially, the available power may be insufficient to handle the loads. In others, stringing cable, antenna wires and electric power conduit inside existing walls can become difficult and quite expensive.

Further, repeated flexing of an appliance power cord often ultimately leads to failure of the power cord. Power cord failures can take various forms, such as broken insulating jackets, exposed bare wires, broken wires, and internal electrical shorts. Cord guards can substantially extend the number of times power cords can be flexed without failure. However, cord guards found in the prior art are not designed specifically for protecting cords or hoses from excessive damage that may occur in doorways, windowsills, and other similar areas. Also, unfortunately, these prior art examples do not include a means for hanging the cord and protector on a wall or other appropriate storage area.

Accordingly, the present invention is disclosed in order to overcome the above noted shortcomings. The present invention is convenient and easy to use, lightweight yet durable in design, and designed for preventing wear and damage to power cords and pneumatic hoses. The cord protective apparatus is simple to use, inexpensive, and designed for many years of repeated use.

BRIEF SUMMARY OF THE INVENTION

In view of the foregoing background, it is therefore an object of the present invention to provide a cord protecting apparatus for shielding an existing cord from incidental nicks that occur when the existing cord is placed through a doorway. These and other objects, features, and advantages of the invention are provided by a cord protecting apparatus preferably including a flexible sheath disposed at a proximal end of the cord protecting apparatus.

Such a sheath may be selectively biased between planar and tubular positions respectively wherein the tubular position is adapted to be wrapped about the existing cord. A posterior face of the sheath may be provided with a first fastener located along the first longitudinal edge of the sheath. An anterior face of the sheath may be provided with a second fastener located along a second longitudinal edge of the sheath. Such first and second longitudinal edges of the sheath may be equidistantly offset from a centrally registered longitudinal axis of the sheath.

A plurality of binding straps may each have a first end statically mated to the sheath. Each of the straps may further have a hook and loop fastener disposed at a second end thereof. Such a second end may be oppositely spaced from the first end. Such first ends of the straps may be statically and permanently mated to each other and thereby, in combination with the second ends, define a sleeve through which the fastener is disposed. Notably, the second ends of the binding straps may be independently detached for releasing the second portion of the existing cord away from the first portion of the existing cord.

Such a sheath defines a first tubular cavity when biased to the tubular position. Such straps preferably define a second tubular cavity when engaged together. Such first and second tubular cavities may be adapted to receive the first and second portions of the existing cord therethrough, respectively. In this manner, the sheath remains spaced from second ends of the straps so that the first and second cord portions are adapted to be freely and independently displaced as desired by the user.

The first ends of the straps may be located at a first longitudinal edge of the sheath and extend away from the sheath such that corresponding longitudinal lengths of the straps are registered orthogonal to the longitudinal length of the sheath respectively. A second end of a first one of the straps is removably engaged and independently biased to a second end of a second one of the straps. In this manner, the straps are adapted to receive a first portion of the existing cord while the sheath is adapted to be wrapped about a second portion of the existing cord.

The present invention further includes a primary fastener pivotally coupled to the first end of the binding straps and located along an outer face of the sheath. Such a primary fastener may be freely pivotal about a fulcrum axis defined parallel to a longitudinal length of the sheath such that the primary fastener articulates about an arcuate path defined exterior of the sheath. The primary fastener may be located medially between opposed lateral ends of the sheath for balancing the sheath at equilibrium during storage.

The present invention may further include a method of utilizing a cord protecting apparatus for shielding an existing cord from incidental nicks that occur when the existing cord is placed through a doorway. Such a method preferably includes the chronological steps of: providing a flexible sheath disposed at a proximal end of the cord protecting apparatus; selectively biasing the sheath between planar and tubular positions respectively such that the sheath is wrapped about the existing cord when adapted to the tubular position; providing a plurality of binding straps; and statically mating a first end of each of the straps to the sheath. Such straps may include a hook and loop fastener disposed at a second end thereof. Such a second end may be oppositely spaced from the first end.

The present invention further includes the chronological steps of: providing and pivotally coupling a primary fastener to the first end of the binding straps wherein the primary fastener may be located along an outer face of the sheath; adapting the straps to receive a first portion of the existing cord while simultaneously wrapping the sheath about a second portion of the existing cord; and independently releasing the second portion of the existing cord away from the first portion of the existing cord by detaching the second ends of the binding straps.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
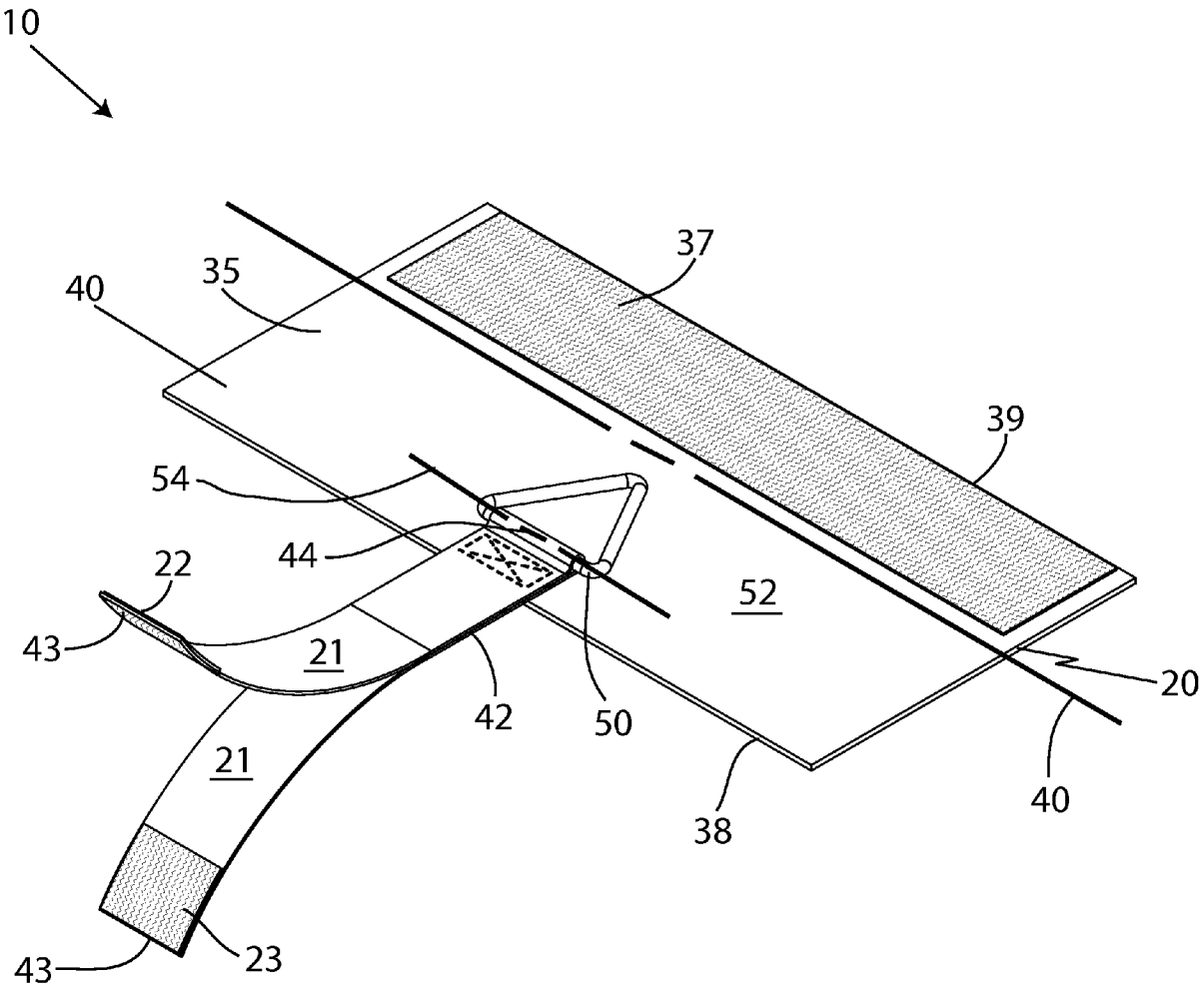
FIG. 1 is a perspective view showing a cord protecting sheath, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus 10 of this invention is referred to generally in the figures and is intended to provide a cord protective apparatus 10, in accordance with the present invention. It should be understood that the apparatus 10 may be used to protect many different types of cords 11 and hoses 11 and should not be limited to protecting only those types of cords 11 and hoses 11 mentioned herein.

Referring to the figures in general, the cord protective apparatus 10 includes a protective, flexible, slip-resistant sheath 20 for use with a cord or hose 11. Binding straps 21 have end portions 43 each having corresponding hook and loop fastener portions 23. The sheath 20 wraps securely around the circumference of a cord/hose 11 for protecting the cord/hose 11 from incidental and accidental nicks and other damage that may occur when the cord/hose 11 is placed through a doorway or other high traffic areas. The apparatus 10 further includes a primary hook 24 to fasten the wrapped cord/hose 11 to a secure mounting structure and conveniently and tidily store said cord/hose 11 in an appropriate place.

The cord protective apparatus 10 helps prevent wear and damage to power cords 11 and pneumatic hoses, thereby resulting in longer life and enhanced safety. In addition, the apparatus 10 assists a user in saving time, expense and frustration that would otherwise occur when a cord/hose 11 received damage in doorways, windowsills, sliding glass doorways, garage doors, and other problematic areas. The apparatus 10 further enhances safety to a user by reducing the chance of electric shock that may occur from exposed wires found in damaged cords.

Although the cord protective apparatus 10 is designed ideally for use in protecting power cords 11 and the like, the size and shape of the apparatus 10 make the unit 10 ideal for use in protecting cords 11 of varying gauges, as well as cords 11 and hoses of any size or length. In addition, the apparatus 10 may be used as a bundling device for grouping cords 11 and hoses together through a doorway, thereby acting as a safety device by decreasing any tripping hazards.

The apparatus 10 may be available in a variety of sizes and colors, as is obvious to one well versed in the art. However, a preferred embodiment of the cord protective apparatus 10 may include a sheath 20 measuring approximately 5" by 9", and the binding straps 21 may preferably be 5" in length, for example. Further, one embodiment of the present invention may be dark in color in order to ensure that the product maintained a clean appearance. Bright orange may be a suitable color for those units used on construction sites or in other locations where safety is of the utmost importance. The primary hook 24 preferably includes of a heavy-duty material such as stainless steel, and the VELCRO 23 may be of industrial strength.

Figure 3:
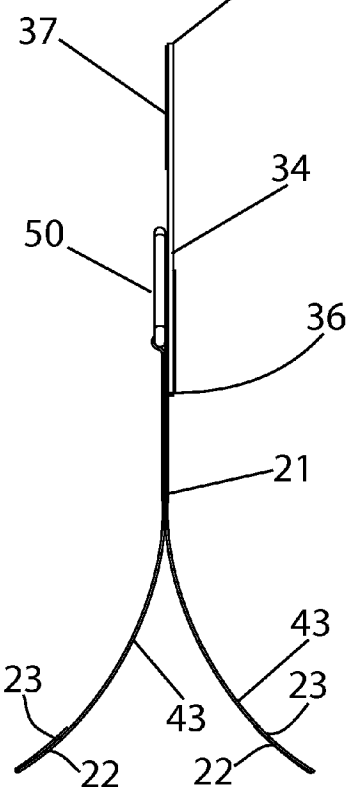
FIG. 3 is a side elevational view of the cord protecting sheath shown in FIG. 1.
Figure 2:
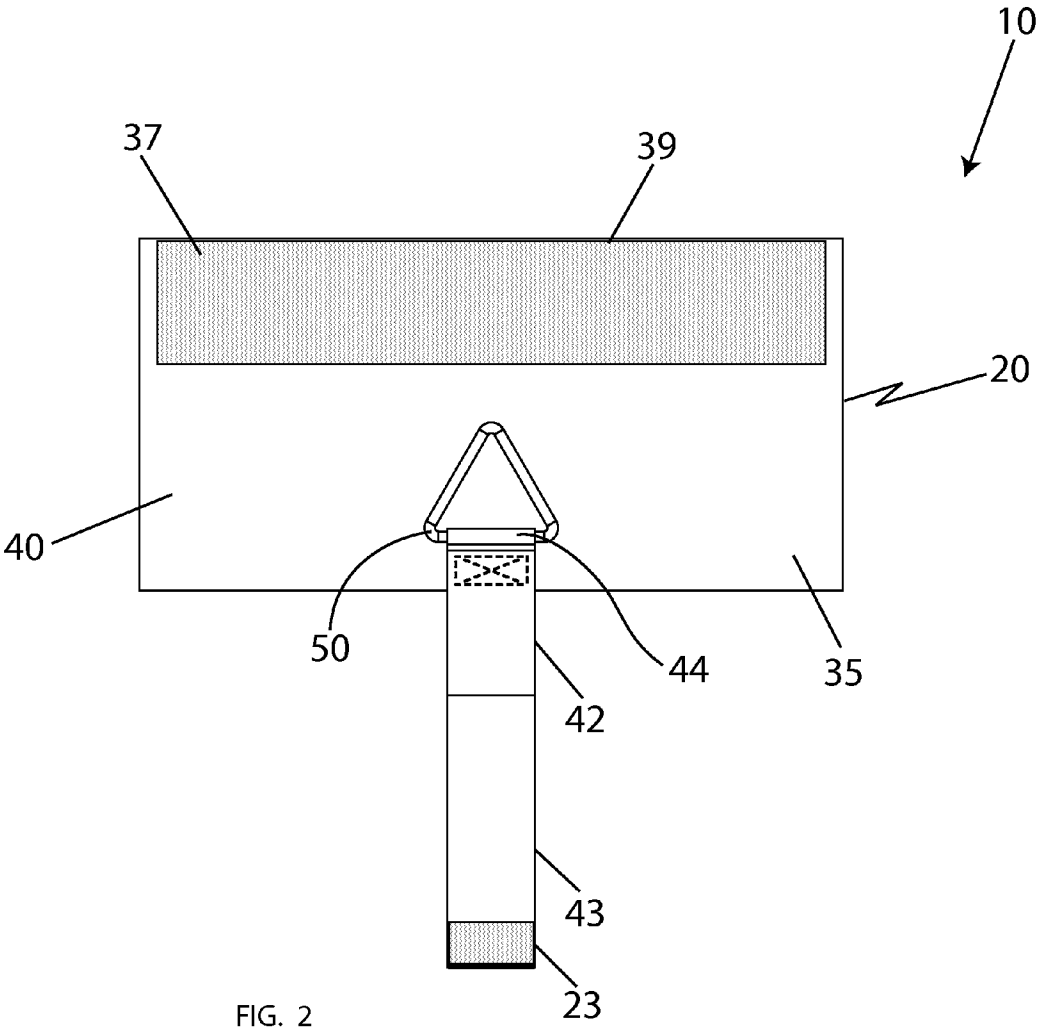
FIG. 2 is a front elevational view of the cord protecting sheath shown in FIG. 1.
Figure 4:
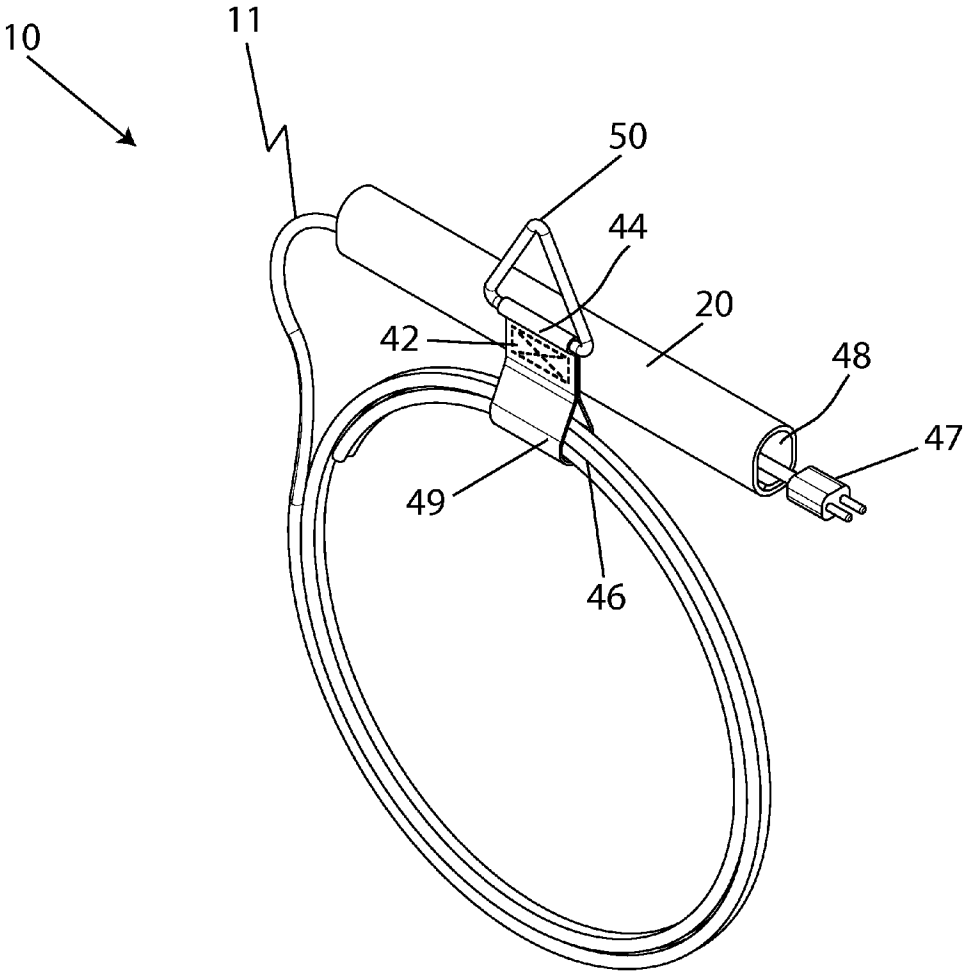
FIG. 4 is a perspective view showing the straps and the sheath adapted to tubular positions and thereby holding the first and second cord portions at substantially stable positions during storage.
Figure 6:
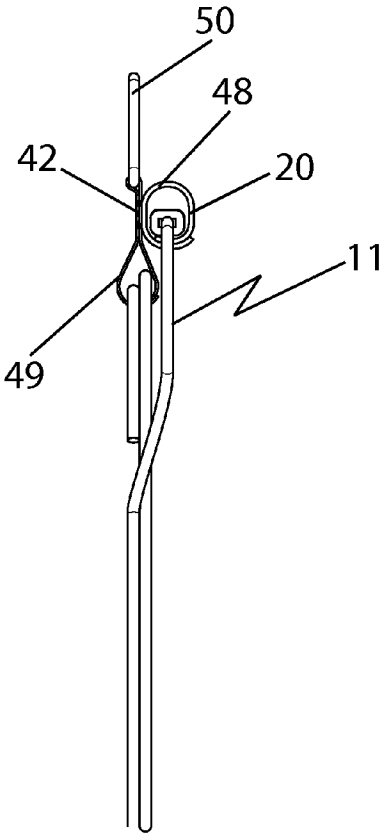
FIG. 6 is a front elevational view of the cord protecting sheath shown in FIG. 4.
Figure 5:
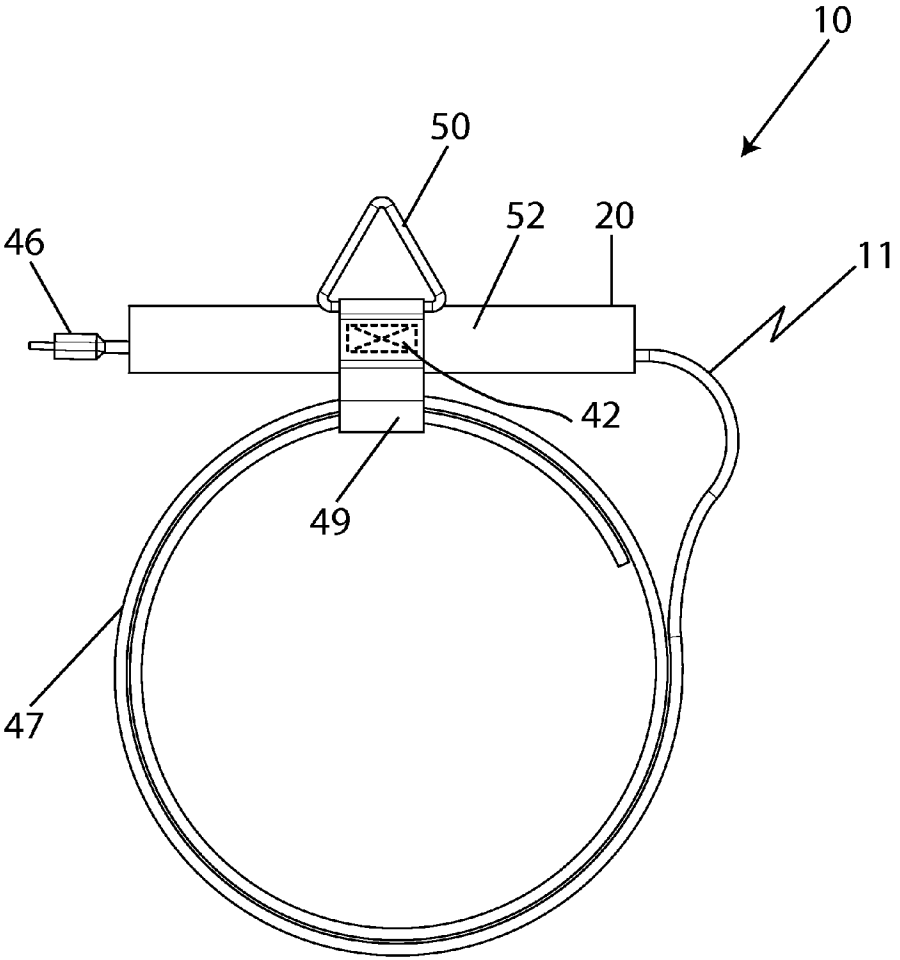
FIG. 5 is a front elevational view of the cord protecting sheath shown in FIG. 4.

Referring to FIGS. 1-6 in more detail, the cord protecting apparatus 10 preferably includes a flexible sheath 20 disposed at a proximal end of the cord protecting apparatus 10. Such a sheath 20 may be selectively biased between planar and tubular positions respectively wherein the tubular position is adapted to be wrapped about the existing cord 11. A posterior face 35 of the sheath 20 may be provided with a first fastener 36 located along the first longitudinal edge 38 of the sheath 20. An anterior face 34 of the sheath 20 may be provided with a second fastener 37 located along a second longitudinal edge 39 of the sheath 20. Such first 38 and second 38 longitudinal edges of the sheath 20 may be equidistantly offset from a centrally registered longitudinal axis 40 of the sheath 20.

A plurality of binding straps 21 may each have a first end 42 statically mated to the sheath 20. Each of the straps 21 may further have a hook and loop fastener 23 disposed at a second end 43 thereof. Such a second end 43 may be oppositely spaced from the first end 42. Such first ends 42 of the straps 21 may be statically and permanently mated to each other and thereby, in combination with the second ends 43, define a sleeve 44 through which the fastener 24 is disposed. Notably, the second ends 43 of the binding straps 21 may be independently detached for releasing the second portion 46 of the existing cord 11 away from the first portion 47 of the existing cord 11.

Such a sheath 20 defines a first tubular cavity 48 when biased to the tubular position. Such straps 21 preferably define a second tubular cavity 49 when engaged together. Such first and second tubular cavities 48, 49 may be adapted to receive the first and second portions 47, 46 of the existing cord 11 therethrough, respectively. In this manner, the sheath 20 remains spaced from second ends 43 of the straps 21 so that the first and second cord portions 46, 47 are adapted to be freely and independently displaced as desired by the user.

The first ends 42 of the straps 21 may be located at a first longitudinal edge 38 of the sheath 20 and extend away from the sheath 20 such that corresponding longitudinal lengths of the straps 21 are registered orthogonal to the longitudinal length of the sheath 20 respectively. A second end 43 of a first one of the straps 21 is removably engaged and independently biased to a second end 43 of a second one of the straps 21. In this manner, the straps 21 are adapted to receive a first portion 47 of the existing cord 11 while the sheath 20 is adapted to be wrapped about a second portion 46 of the existing cord 11.

The present invention further includes a primary fastener 50 pivotally coupled to the first end 42 of the binding straps 21 and located along an outer face 52 of the sheath 20. Such a primary fastener 50 may be freely pivotal about a fulcrum axis 54 defined parallel to a longitudinal length of the sheath 20 such that the primary fastener 50 articulates about an arcuate path defined exterior of the sheath 20. The primary fastener 50 may be located medially between opposed lateral ends of the sheath 20 for balancing the sheath 20 at equilibrium during storage.

The present invention may further include a method of utilizing a cord protecting apparatus 10 for shielding an existing cord 11 from incidental nicks that occur when the existing cord 11 is placed through a doorway. Such a method preferably includes the chronological steps of: providing a flexible sheath 20 disposed at a proximal end of the cord protecting apparatus 10; selectively biasing the sheath 20 between planar 32 and tubular 28 positions respectively such that the sheath 20 is wrapped about the existing cord 11 when adapted to the tubular position; providing a plurality of binding straps 21; and statically mating a first end 42 of each of the straps 21 to the sheath 20. Such straps 21 may include a hook and loop fastener 23 disposed at a second end 43 thereof. Such a second end 43 may be oppositely spaced from the first end 42.

The present invention further includes the chronological steps of: providing and pivotally coupling a primary fastener 50 to the first end 42 of the binding straps 21 wherein the primary fastener 50 may be located along an outer face of the sheath 20; adapting the straps 21 to receive a first portion 47 of the existing cord 11 while simultaneously wrapping the sheath 20 about a second portion 46 of the existing cord 11; and independently releasing the second portion 46 of the existing cord 11 away from the first portion 47 of the existing cord 11 by detaching the second ends 43 of the binding straps 21.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A cord protecting apparatus for shielding an existing cord from incidental nicks that occur when the existing cord is placed through a doorway, said cord protecting apparatus comprising:

a flexible sheath disposed at a proximal end of said cord protecting apparatus, said sheath being selectively biased between planar and tubular positions respectively wherein said tubular position is adapted to be wrapped about the existing cord;

a plurality of binding straps each having a first end statically mated to said sheath, each of said straps further having a hook and loop fastener disposed at a second end thereof, said second end being oppositely spaced from said first end; and a primary fastener pivotally coupled to said first ends of said binding straps and located along an outer face of said sheath;

wherein said straps are adapted to receive a first portion of the existing cord while said sheath is adapted to be wrapped about a second portion of the existing cord;

wherein said primary fastener is freely pivotal about a fulcrum axis defined parallel to a longitudinal length of said sheath such that said primary fastener articulates about an arcuate path defined exterior of said sheath.

2. The cord protecting sheath of claim 1, wherein said second end of a first one of said straps is removably engaged and independently biased a second end of a second one of said straps.

3. The cord protecting sheath of claim 2, wherein said sheath defines a first tubular cavity when biased to said tubular position, said straps defining a second tubular cavity when engaged together, said first and second tubular cavities being adapted to receive said first and second portions of the existing cord therethrough respectively.

4. The cord protecting sheath of claim 1, wherein said first ends of said straps are located at a first longitudinal edge of said sheath and extend away from said sheath such that corresponding longitudinal lengths of said straps are registered orthogonal to said longitudinal length of said sheath respectively.

5. The cord protecting sheath of claim 4, wherein a posterior face of said sheath is provided with a first fastener located along said first longitudinal edge of said sheath, wherein an anterior face of said sheath is provided with a second fastener located along a second longitudinal edge of said sheath, said first and second longitudinal edges of said sheath being equidistantly offset from a centrally registered longitudinal axis of said sheath.

6. The cord protecting sheath of claim 1, wherein said primary fastener is located medially between opposed lateral ends of said sheath for balancing said sheath at equilibrium during storage.

7. The cord protecting sheath of claim 1, wherein said first ends of said straps are statically and permanently mated to each other and thereby define a sleeve through which said fastener is disposed.

8. The cord protecting sheath of claim 1, wherein said sheath remains spaced from said second ends of said straps so that the first and second cord portions are adapted to be freely and independently displaced as desired by the user.

9. A cord protecting apparatus for shielding an existing cord from incidental nicks that occur when the existing cord is placed through a doorway, said cord protecting apparatus comprising:

a flexible sheath disposed at a proximal end of said cord protecting apparatus, said sheath being selectively biased between planar and tubular positions respectively wherein said tubular position is adapted to be wrapped about the existing cord;

a plurality of binding straps each having a first end statically mated to said sheath, each of said straps further having a hook and loop fastener disposed at a second end thereof, said second end being oppositely spaced from said first end; and a primary fastener pivotally coupled to said first ends of said binding straps and located along an outer face of said sheath;

wherein said straps are adapted to receive a first portion of the existing cord while said sheath is adapted to be wrapped about a second portion of the existing cord;

wherein said second ends of said binding straps are independently detached for releasing said second portion of the existing cord away from said first portion of the existing cord;

wherein said primary fastener is freely pivotal about a fulcrum axis defined parallel to a longitudinal length of said sheath such that said primary fastener articulates about an arcuate path defined exterior of said sheath.

10. The cord protecting sheath of claim 9, wherein said second end of a first one of said straps is removably engaged and independently biased a second end of a second one of said straps.

11. The cord protecting sheath of claim 10, wherein said sheath defines a first tubular cavity when biased to said tubular position, said straps defining a second tubular cavity when engaged together, said first and second tubular cavities being adapted to receive said first and second portions of the existing cord therethrough respectively.

12. The cord protecting sheath of claim 9, wherein said first ends of said straps are located at a first longitudinal edge of said sheath and extend away from said sheath such that corresponding longitudinal lengths of said straps are registered orthogonal to said longitudinal length of said sheath respectively.

13. The cord protecting sheath of claim 12, wherein a posterior face of said sheath is provided with a first fastener located along said first longitudinal edge of said sheath, wherein an anterior face of said sheath is provided with a second fastener located along a second longitudinal edge of said sheath, said first and second longitudinal edges of said sheath being equidistantly offset from a centrally registered longitudinal axis of said sheath.

14. The cord protecting sheath of claim 9, wherein said primary fastener is located medially between opposed lateral ends of said sheath for balancing said sheath at equilibrium during storage.

15. The cord protecting sheath of claim 9, wherein said first ends of said straps are statically and permanently mated to each other and thereby define a sleeve through which said fastener is disposed.

16. The cord protecting sheath of claim 9, wherein said sheath remains spaced from said second ends of said straps so that the first and second cord portions are adapted to be freely and independently displaced as desired by the user.

* * * * *